US005415712A

United States Patent [19]

Thamboo

[11] Patent Number: 5,415,712

[45] Date of Patent: May 16, 1995

[54] METHOD OF FORGING IN 706 COMPONENTS

[75] Inventor: Samuel V. Thamboo, Schenectady, N.Y.

[73] Assignee: General Electric Company, Schenectady, N.Y.

[21] Appl. No.: 162,211

[22] Filed: Dec. 3, 1993

[51] Int. Cl.[6] ..... C21D 8/00

[52] U.S. Cl. ..... 148/707

[58] Field of Search ..... 148/707, 677, 410, 419

[56] References Cited

U.S. PATENT DOCUMENTS 3,660,177 5/1972 Brown et al. .
3,930,904 1/1976 Eiselstein et al. .
4,652,315 3/1987 Igarashi et al. ..... 148/419

OTHER PUBLICATIONS

H. L. Eiselstein: "Properties of a Fabricable, High Strength Superalloy" Nov. 1971 published in *Metals Engineering Quarterly.*

*Primary Examiner*—Deborah Yee
*Attorney, Agent, or Firm*—Nixon & Vanderhye

[57] ABSTRACT

In a method of forging an IN 706 alloy component, the component is forged at about 1750° F. to 1825° F. The component is cooled by quenching to minimize the formation of embrittling grain boundary phases, and subsequently air cooled to prevent surface cracking in the forging. The component is aged to precipitate gamma prime. Preferably, the quenching is performed to lower the temperature throughout the component below about 1500° F.

9 Claims, 2 Drawing Sheets

METHOD OF FORGING IN 706 COMPONENTS

BACKGROUND OF THE INVENTION

1. Field of the Invention

This invention relates to a method for forging IN 706 components.

2. Description of the Related Art

Inconel Alloy 706 is a nickel based super alloy having high strength up to about 1200° F. and resistance to embrittlement. As a result, it has found use in a number of gas turbine components. The IN 706 alloy has the composition shown below, from the AMS specification 5703B.

| Element | Weight Percent |
|---|---|
| carbon | 0.06 max. |
| manganese | 0.35 max. |
| phosphorus | 0.35 max. |
| sulfur | 0.015 max. |
| chromium | 14.5 to 17.5 |
| nickel | 39 to 44 |
| niobium | 2.5 to 3.3 |
| titanium | 1.5 to 2 |
| aluminum | 0.4 max. |
| boron | 0.006 max. |
| copper | 0.3 max. |
| iron | balance |

In "Properties of a Fabricable, High Strength Alloy," H. L. Eiselstein, Metals Engineering Quarterly, November 1971, pages 20–25 two heat treatments are disclosed for the IN706 alloy. A first heat treatment has three steps, annealing at 1800° F. for 30 minutes, air cooling to 1550° F., holding for 3 hours, air cooling to 1325° F., holding for 8 hours, furnace cooling to 1150° F., holding for 8 hours, and air cooling. An alternative two step heat treatment eliminates the 1550° F. step from the three step treatment. Eiselstein discloses higher tensile strength, elongation, and toughness for the two step treatment.

A conventional thermomechanical treatment for nickel base superalloys provides for air cooling to room temperature after the forging process. The forging is machined to remove surface irregularities introduced during the forging process, and solutioned by heating to a temperature where precipitate phases are dissolved and placed into solid solution. Next the forging is water or oil quenched, and aged by heating the billet at specific temperatures to precipitate phases, such as gamma prime, which develop the desired mechanical properties in the alloy.

The forged surface has a number of surface irregularities that can act as stress raisers that initiate cracking during the quenching step. As the forging size increases, the temperature difference between the surface and center of the forging increases, and the surface stresses caused by the quenching step increase. As a result, the forged surface is machined smooth prior to the solutioning and quenching steps to prevent cracks from forming in the surface of the forging during the quench.

I have discovered the conventional forging process has several disadvantages when performed on IN 706 large forgings, such as rotor wheels in gas turbines. Air cooling after forging permits the grains in the interior of the large forging to recrystallize and grow to large sizes. In addition, reheating to solution treat the large forging after it has been cooled to room temperature requires several hours at about 1800° F. causing further increase in grain size.

It is well known that grain growth reduces cyclic fatigue life, and therefore a fine grain size is desirable to provide improved low cycle fatigue life. A fine grain size also permits improved ultrasonic inspection of the alloy members, so that smaller defects can be detected during inspection. Therefore, a fine grain size is desired to improve service life of IN 706 alloy components.

It is an object of this invention to provide a forging process for IN 706 that minimizes the time at solution and forging temperatures to minimize grain growth.

Another object of this invention is to provide large IN 706 forgings having a finer grain size.

Another object of this invention is to provide a simplified forging process for IN 706 with a reduced number of steps.

Another object of this invention to provide a forging process for IN 706 that minimizes the formation of embrittling grain boundary phases.

BRIEF DESCRIPTION OF THE INVENTION

The method of this invention reduces the steps required to forge IN 706 members by eliminating the machining step after forging, and the reheating step to solution the machined forging. I have found that IN 706 large forgings can be quenched to an intermediate temperature that reduces grain growth, and subsequently air cooled to room temperature. The two step cooling after forging reduces grain growth while at the same time reducing surface stresses to prevent surface cracking of the as forged surface of the component.

In addition, I have discovered that embrittling grain boundary phases form when IN 706 forgings are slowly cooled between about 1500° F. to 1750° F. Preferably, the forgings are cooled in a manner to minimize the time the forging is within the temperature range of 1500° F. to 1750° F. to minimize the formation of such embrittling phases.

After cooling to room temperature, the forging can be aged to precipitate gamma prime phase to provide desired strength, toughness, and ductility. Preferably, the aging is performed to precipitate both gamma prime, and gamma double prime precipitates. A final machining operation can be performed to form the component from the forging.

DETAILED DESCRIPTION OF THE DRAWINGS

The following detailed description of the invention refers to the drawings in which.

DETAILED DESCRIPTION OF THE INVENTION

Figure 1:
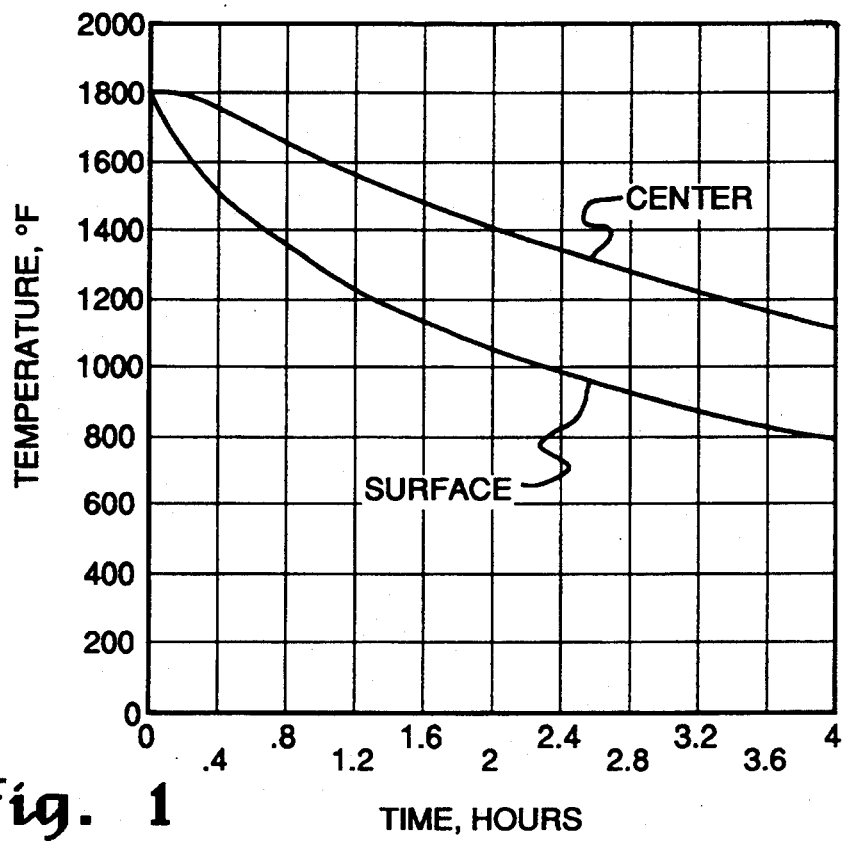
FIG. 1 is a graph from a computer simulation showing the cooling rate at the surface and center of a large forging air cooled from 1800° F. to room temperature.

The IN 706 alloy can be melted and cast by conventional methods, such as vacuum induction melting to form electrodes, and remelting the electrodes by the vacuum arc or electroflux process to form ingots. The ingot is forged at about 1750° F. to 1825° F., preferably about 1775° F. to 1825° F., and most preferably about 1800° F. At temperatures above about 1825° F., undesirable grain growth occurs, and below about 1750° F., undesirable grain boundary embrittling phases form and nonuniform grain growth can occur.

Preferably, the forging is heated to about 1750° F. to 1825° F., preferably about 1775° F. to 1825° F., and most preferably about 1800° F. for a period of time to recrystallize the forging strained microstructure and provide a uniform grain size. More preferably, the forging is heated for a period of time to provide a uniform temperature throughout the cross-section of the forging. Since this heating step is performed directly after forging, it can be performed in a relatively brief period of about 0.25 to one hour minimizing grain growth in the forged billet. The time period will depend upon the cross-sectional area of the particular with larger cross sections requiring longer times.

In the conventional forging process, the forging is air cooled to room temperature and machined, resulting in grain growth during the slow air cooling from the forging temperature. In addition, the machined billet must be reheated to a temperature, and for a period of time, sufficient to solution the precipitates and provide a uniform temperature throughout the cross section of the forging. As a result, the forging is reheated to about 1800° F. for about 8 to 16 hours causing additional grain growth. Such additional grain growth is minimized by the method of this invention since a relatively short solutioning treatment can be performed directly after forging.

The forging is cooled by first quenching in water or oil for a period of time to cool the entire cross section of the forging below a temperature where embrittling grain boundary phases form, preferably, below about 1500° F. A well known embrittling phase that forms in the IN 706 alloy is the eta phase, a compound of nickel, titanium, and columbium having the approximate formula $Ni_3(Ti,Nb)$. The eta phase precipitates in the form of thin plates, preferentially at the grain boundaries in the IN 706 alloy. The eta precipitate can form within one hour at about 1600° to 1650° F. At temperatures above and below this range precipitation of the eta phase is much slower. The eta precipitate does not form above about 1750° F., and at temperatures below 1500° F. the precipitation rate is very slow. Preferably, the cooling is performed to minimize the time the forging is between about 1750° F. to 1500° F. to minimize the formation of the embrittling grain boundary phases.

The period of time required to cool the forging will depend upon the cross-sectional area of the forging. Conventional techniques can be used to determine the quenching time required to cool the center of a known cross-section below the 1750° F. to 1500° F. temperature range. For example, a suitable period of time for quenching a large forging such as a rotor wheel of about seventy five inches in diameter and ten inches thickness below the 1750° F. to 1500° F. temperature range is about ten to twenty minutes. The forging is removed from the quench tank and air cooled to room temperature.

Figure 2:
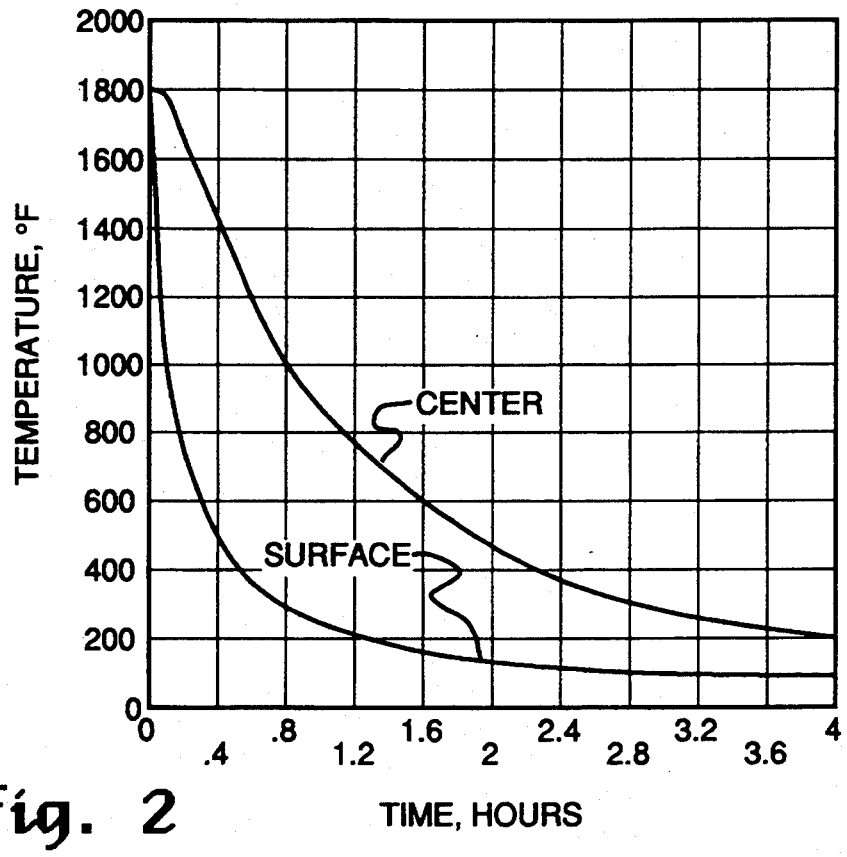
FIG. 2 is a graph from a computer simulation showing the cooling rate at the surface and center of a large forging water quenched from 1800° F. to room temperature.
Figure 3:
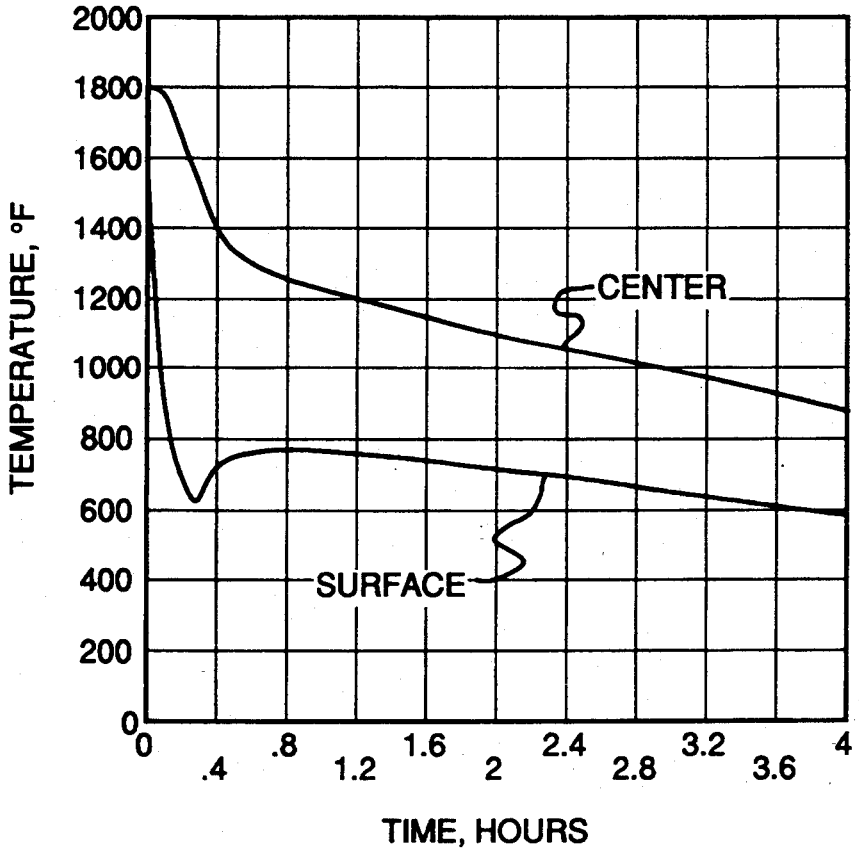
FIG. 3 is a graph from a computer simulation showing the cooling rate at the surface and center of a large forging cooled by a two step process of quenching followed by air cooling from 1800° F. to room temperature.

Referring to FIGS. 1–3, the cooling rates for air cooling, quenching, and the two step quenching and air cooling process of this invention for a large forging about 75 inches in diameter and 10 inches thick were simulated using a computer program, Ansys 5.0, available from Swanson Analysis Systems, Inc., Pa. The cooling rate from 1800° F. to room temperature at the surface and center of the forging is plotted on the graphs of FIGS. 1–3. The cooling rate for air cooling is shown in FIG. 1, quenching in FIG. 2, and the two step quenching and air cooling process is shown in FIG. 3.

Referring to FIG. 1, when the forging is air cooled from the solutioning or forging temperature, the center of the forging cools slowly through the 1500° F. to 1750° F. temperature range where precipitation of the embrittling grain boundary phases occurs. In addition, the center is cooling slowly from 1800° F. to 1700° F. where grain growth occurs.

Referring to FIG. 2, when the forging is quenched all the way to room temperature, a large temperature difference is shown between the surface and center of the forging. The large temperature difference exists even as the surface cools below 200° F. and approaches room temperature. As the surface of the forging cools it becomes harder and less ductile so that the surface stresses from quenching can initiate cracking at the surface irregularities from forging.

However, when the forging is cooled by the two step method of this invention, it is quenched for a minimal period of time to minimize the formation of the embrittling grain boundary phases, and subsequently air cooled. As a result, the quenching is limited so the forging remains at a temperature where the alloy has sufficient ductility to prevent surface cracking. Referring to FIG. 3, the two step cooling process in the method of this invention rapidly cools the center of the forging through the 1750° F. to 1500° F. temperature range to minimize grain growth and the formation of grain boundary embrittling phases. The forging is then air cooled to room temperature reducing the temperature difference between the surface and center of the forging to prevent cracking at the surface. Such cooling minimizes surface stresses when the surface of the forging is at lower temperatures and ductility in the alloy is reduced.

An aging heat treatment process is performed on the cooled forging to precipitate phases providing desired strengthening, ductility, and toughness in the component. The phases precipitated are at least gamma prime, and preferably, gamma double prime. The age hardening to form gamma prime precipitates can be performed at about 1000° to 1600° F. A preferred aging treatment comprises heating to about 1325° F. for about 8–16 hours, furnace cooling at 100° F. per hour to 1150° F., holding at about 1150° F. for 8–16 hours, and cooling to room temperature. After the age hardening heat treatment, the forging can be machined, for example, to form a rotor wheel for a gas turbine.

EXAMPLE 1

Small samples of the IN 706 alloy were compressed isothermally at 1800° F. in a press forging fixture at a strain rate of 0.35/second in two steps to a total strain of 0.7 to simulate a forging process for a large casting. After pressing, a first sample was heated at 1800° F. for about 15 minutes, and a second for about 30 minutes. The samples were quenched in water for about 10 minutes to room temperature, and age hardened according to the preferred heat treatment described above. The samples were cross sectioned and examined by conventional metallographic techniques. The first and second samples had ASTM grain sizes of about 6.0 and 5.5, respectively.

Rotor wheel forgings of the IN706 alloy formed by the conventional forging process provide an ASTM grain size of about 2 to 4. This example shows that the minimal heating after forging in the method of this invention provides a finer grain size as compared to the conventional forging process.

EXAMPLE 2

A sample was machined from a forging processed by the conventional forging process, and having a grain size of about ASTM 3 to 4. The sample was heated to 1800° F., and furnace cooled using a furnace control program simulating the cooling rate shown in FIG. 3 for the center position. A second sample heated to 1800° F. was furnace cooled using a furnace control program simulating the cooling rate shown in FIG. 2 for the center position. The samples were sectioned and examined metallographically by conventional methods. No grain boundary phases were observed in the first sample, while the grain boundaries in the second sample were littered with eta phase.

EXAMPLE 3

A number of surface irregularities, simulating the irregulatities on an as forged surface, were introduced onto the surface of a forging about 60 inches in diameter and 12 inches thick. The forging was heated to 1800° F. and quenched for 10 minutes in water, then air cooled to room temperature. The forging was aged according to the preferred aging heat treatment described above. No cracks were detected by visual observation or dye penetrant testing of the forging surface.

The same forging was processed as described above except it was quenched for 20 minutes. Small cracks were observed in the surface of the forging. This example shows the limited quenching performed in the two step cooling process in the method of this invention can prevent the formation of cracks in the as forged surface of a large forging.

What is claimed is:

1. A method of forging an IN 706 alloy component comprising:

forging the component at about 1750° F. to 1825° F., cooling the component in two steps by first quenching to minimize the formation of embrittling grain boundary phases, and subsequently air cooling to prevent surface cracking in the forging, and aging the component to precipitate gamma prime.

2. A method according to claim 1 wherein the quenching is performed to lower the temperature throughout the component below about 1500° F.

3. A method according to claim 1 comprising, after the step of forging, heating the component at about 1750° F. to 1825° F. to provide a uniform grain size.

4. A method according to claim 3 wherein the component is heated for about 0.25 to 1 hour.

5. A method according to claim 1 wherein the aging is performed by heating to about 1325° F. for 8–16 hours, furnace cooling at 100° F. per hour to 1150° F., holding at about 1150° F. for 8–16 hours, and cooling to room temperature.

6. A method of forging an IN 706 alloy component comprising:

forging the component at about 1750° F. to 1825° F., cooling the component by quenching to minimize the formation of embrittling grain boundary phases, and subsequently air cooling to prevent surface cracking in the forging, and aging the component by heating to about 1325° F. for 8–16 hours, furnace cooling at 100° F. per hour to 1150° F., holding at about 1150° F. for 8–16 hours, and cooling to room temperature.

7. A method according to claim 6 wherein the quenching is performed to lower the temperature of the component below about 1500° F.

8. A method according to claim 6 comprising, after the step of forging, heating the component at about 1750° F. to 1825° F. to provide a uniform grain size.

9. A method according to claim 8 wherein after the step of forging the component is heated for about 0.25 to 1 hour.

* * * * *